US008228200B2

(12) United States Patent
Kolton et al.

(10) Patent No.: US 8,228,200 B2
(45) Date of Patent: Jul. 24, 2012

(54) ELECTRONIC TAG HOLDER FOR BOTTLE NECK

(75) Inventors: Chester Kolton, Westfield, NJ (US); Michael Norman, East Brunswick, NJ (US); Alex Tetiyevsky, Springfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 265 days.

(21) Appl. No.: 12/566,807

(22) Filed: Sep. 25, 2009

(65) Prior Publication Data

US 2010/0085191 A1 Apr. 8, 2010

Related U.S. Application Data

(60) Provisional application No. 61/102,532, filed on Oct. 3, 2008.

(51) Int. Cl.
*G08B 13/14* (2006.01)
*G08B 23/00* (2006.01)

(52) U.S. Cl. ..... 340/572.8; 340/572.1; 340/693.5; 340/693.9

(58) Field of Classification Search ..... 340/568.1, 340/571, 572.1, 572.8, 572.9, 693.5, 693.9; 215/201, 211, 215, 274, 275; 435/304.1; 156/86, 203, 209
See application file for complete search history.

(56) References Cited

U.S. PATENT DOCUMENTS

| | | | | |
|---|---|---|---|---|
| 3,685,676 A | | 8/1972 | Gach et al. | |
| 3,756,444 A | | 9/1973 | McIntosh | |
| 3,853,236 A | | 12/1974 | Ostrowsky | |
| 3,902,339 A | | 9/1975 | Carley et al. | |
| 3,915,326 A | | 10/1975 | Hrubesky | |
| 4,018,640 A | * | 4/1977 | Amberg | 156/86 |
| 4,089,463 A | | 5/1978 | Babiol | |
| 4,176,756 A | | 12/1979 | Gellman | |
| 4,241,188 A | * | 12/1980 | Materia et al. | 435/304.1 |
| 4,405,161 A | | 9/1983 | Young et al. | |
| 4,457,445 A | | 7/1984 | Hanks et al. | |
| 4,471,982 A | | 9/1984 | Nielsen, Jr. | |
| 4,674,778 A | | 6/1987 | Ruiz | |
| 4,729,487 A | | 3/1988 | Wright | |
| 4,813,564 A | | 3/1989 | Cooper et al. | |
| 5,230,541 A | | 7/1993 | Nowak | |
| 5,602,530 A | | 2/1997 | Holmgren | |
| 5,667,085 A | | 9/1997 | Ogden et al. | |
| 6,137,413 A | | 10/2000 | Ryan, Jr. | |
| 6,254,139 B1 | | 7/2001 | Fresnel | |
| 6,342,838 B1 | | 1/2002 | Kolton et al. | |
| 6,604,643 B1 | | 8/2003 | Michael et al. | |

(Continued)

FOREIGN PATENT DOCUMENTS

GB 2465892 A 6/2010

(Continued)

*Primary Examiner* — Van T. Trieu
(74) *Attorney, Agent, or Firm* — Hoffmann & Baron, LLP

(57) ABSTRACT

A device supports an electronic tag to extending neck of a bottle where the extending neck includes a perimetrical undercut thereabout. The device includes a housing formed of a pair of matable housing portions for attachment about the neck of the bottle. At least one of the housing portions supports an electronic tag. A rim is formed on each housing portion. The rim portions are mutually engageable and align to form a perimetrical rim. The perimetrical rim of the housing is seatable in the undercut of the neck to prevent longitudinal movement of the mated housing portions along the neck.

8 Claims, 4 Drawing Sheets

U.S. PATENT DOCUMENTS

| | | | | |
|---|---|---|---|---|
| 6,696,955 | B2 | 2/2004 | Kolton et al. | |
| 6,831,552 | B2 | 12/2004 | Lin | |
| D506,694 | S | 6/2005 | Corney | |
| 7,048,179 | B2 | 5/2006 | Claessens et al. | |
| 7,061,382 | B2 | 6/2006 | Claessens et al. | |
| 7,394,383 | B2 | 7/2008 | Hager et al. | |
| 7,804,405 | B2 * | 9/2010 | Norman et al. | 340/572.1 |
| 2006/0151414 | A1 | 7/2006 | Mullen | |
| 2007/0062903 | A1 | 3/2007 | Norman et al. | |
| 2007/0285243 | A1 | 12/2007 | Feibelman | |
| 2008/0030334 | A1 | 2/2008 | Marsilio et al. | |
| 2008/0048868 | A1 | 2/2008 | Chua et al. | |
| 2008/0230509 | A1 | 9/2008 | Koo et al. | |
| 2008/0289372 | A1 | 11/2008 | Rendon et al. | |
| 2010/0133224 | A1 | 6/2010 | Kolton et al. | |
| 2010/0253524 | A1 | 10/2010 | Kolton et al. | |
| 2011/0074583 | A1 | 3/2011 | Kolton et al. | |

FOREIGN PATENT DOCUMENTS

| | | | |
|---|---|---|---|
| WO | 2007/086984 | A1 | 8/2007 |
| WO | 2008/075310 | | 6/2008 |

* cited by examiner

ELECTRONIC TAG HOLDER FOR BOTTLE NECK

CROSS-REFERENCE TO RELATED APPLICATION

This application claims priority to U.S. Provisional Patent Application No. 61/102,532, filed on Oct. 3, 2008, which is incorporated herein by reference.

FIELD OF THE INVENTION

The present invention relates generally to a holder for an electronic tag. More particularly, the present invention relates to a holder for an electronic tag which may be applied to a bottle neck.

BACKGROUND OF THE INVENTION

Electronic tags are used for a wide variety of purposes, including the tracking of items which contain the tag, inventory control, security, and also provide information which may be electronically readable.

These tags or markers may include radio frequency identification (RFID) tags or electronic article surveillance (EAS) tags. EAS tags may be used to provide theft deterrence. These tags are used in combination with an alarm system which monitors undesired movement of the article containing the EAS tag.

Devices such as holders or housings for such tags have been developed which accommodate the electronic tag and which attach the tags to the desired article. It is desired that the tags be securely supported to the article in such a manner where it remains with the article until the time of purchase.

With respect to some articles, such as beverage bottles, various housings have been developed to secure the tag to different locations on the bottle. One troublesome location to apply tags is to the outside surface of the neck of the bottle. While this is a desirous location to apply the tag, it is difficult to retain the tag thereon, as the tag housing can normally be removed by sliding the housing up over the extending neck.

It is therefore desirable to provide a tag housing which may be secured to the outside surface of a bottle neck and can not be readily removed therefrom.

SUMMARY OF THE INVENTION

The present invention provides a device for supporting an electronic tag to an extending neck of the bottle where the bottle includes a perimetrical undercut thereabout. The device includes a housing formed of a pair of matable housing portions for attachment about the neck of the bottle, at least one of the housing portions providing support for the tag. A rim portion is formed on ach of the housing portions. The rim portion of each housing portion being mutually aligned to form a perimetrical rim. The perimetrical rim of the housing portions is seatable in the undercut of the of the neck to prevent longitudinal movement of the mated housing portions along the neck.

In an alternative embodiment, the housing portions may be hermaphroditically configured.

Moreover, in a preferred embodiment, the housing is designed to engage an undercut formed in the bottle neck. However, the undercut may also consist of the bottom edge of a label placed on the neck of the bottle.

DETAILED DESCRIPTION OF THE INVENTION

The present invention provides a device for supporting electronic tag on the neck of a bottle.

Figure 1:
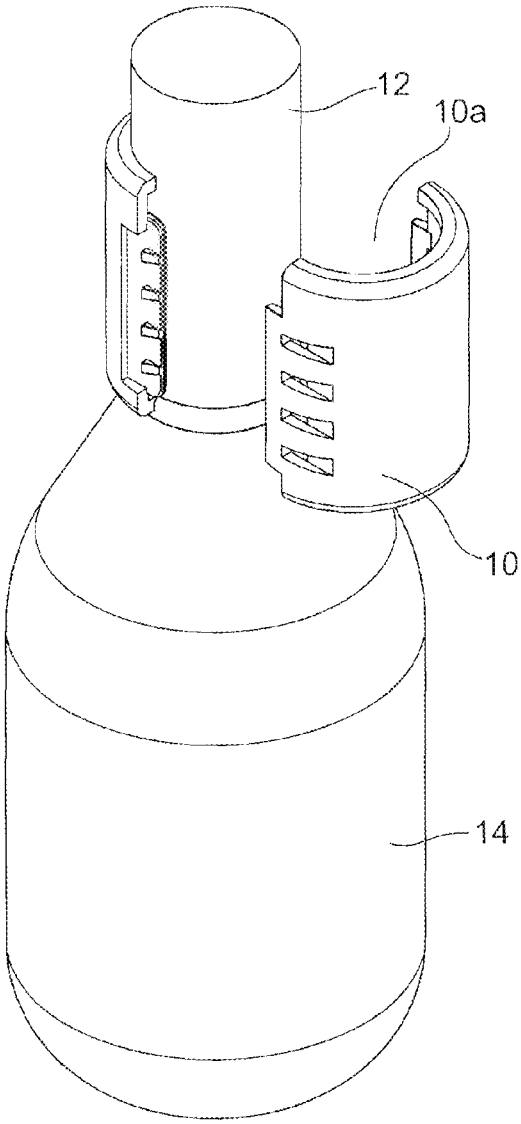
FIGS. 1 and 2 are perspective showings of the electronic tag housing of the present invention attachable to the neck of a bottle.
Figure 2:
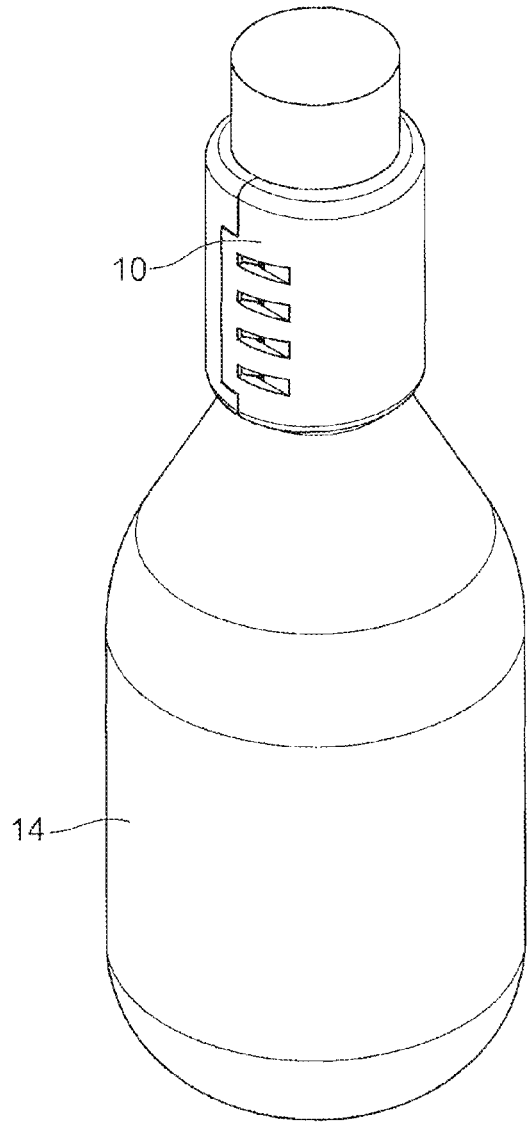

As shown in FIGS. 1 and 2, the device of the present invention includes a tag holder or housing 10 which is designed to be supported on the neck 12 of a bottle 14. The housing 10 supports an electronic tag 16 (FIG. 6) such as a radio frequency identification (RFID) tag, an electronic article security tag (EAS) tag or any similar electronic tag.

The present invention is designed to attach the tag 16 to the bottle 14 where the bottle includes a perimetrical undercut 20 which in this case is a circumferential undercut, in order to prevent the tag housing 10 from being removed from the neck of the bottle.

Figure 5:
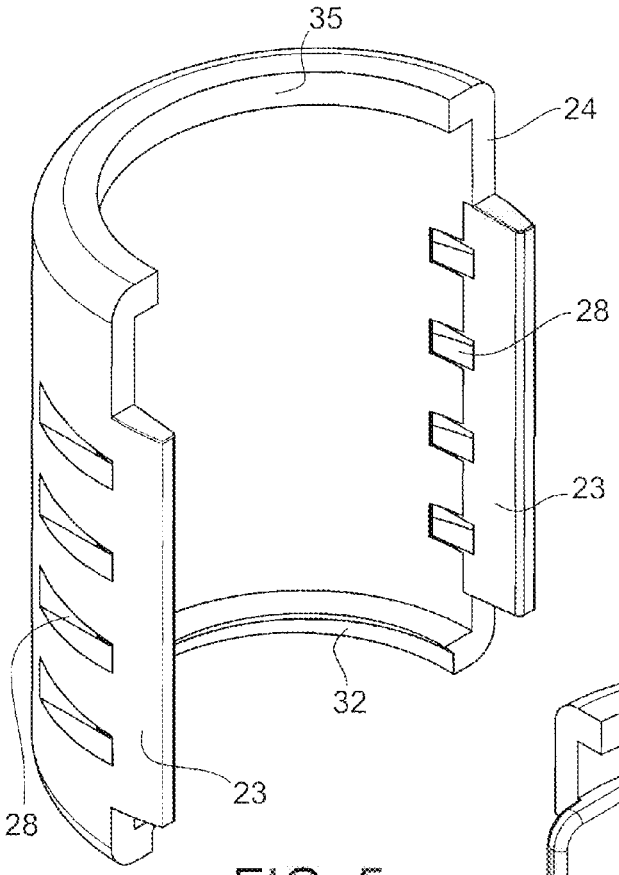
FIGS. 5 and 6 are perspective views of the housing portions forming the tag housing of the present invention.
Figure 6:
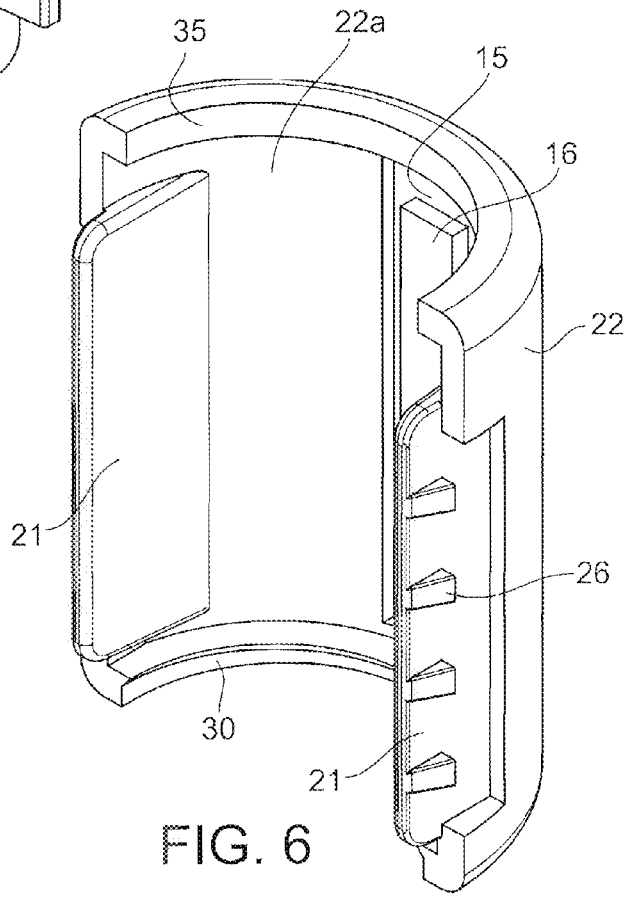

The housing 10 includes two semi-cylindrical housing halves or portions 22 and 24. One housing portion 22 is shown in FIG. 5, while the other housing portion 24 is shown in FIG. 6.

Figure 3:
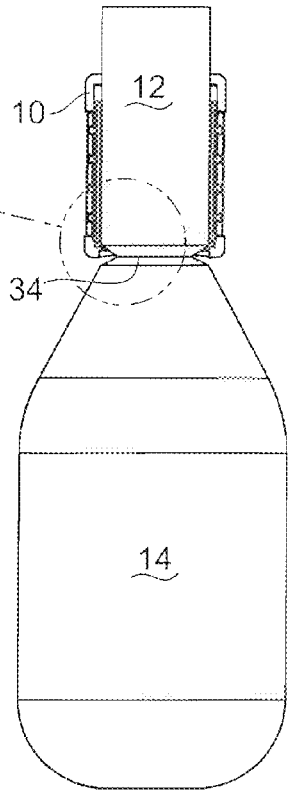
FIG. 3 is a plan view, partially in section, of the electronic tag housing of the present invention attached to the bottle neck.

As shown in FIGS. 2 and 3, the housing 10, when assembled, is generally a cylindrical body having a central bore 10*a* with a diameter which is designed to accommodated the extending neck 12 of bottle 14. The tag 16 may be secured to one of the housing portions 22 or 24. As shown in FIG. 6, one housing portion 22 may include a recessed portion 15 in the inner wall 22*a* thereof. The tag 16 may be secured to the inner wall 22*a* within the recessed portion 15. Any securement technique such as adhesive may be used to attach the tag 16 to the wall 22*a* of housing 22.

The housing portions 22 and 24 are interlockable to secure the mated housing about the neck 12 of bottle 14. The housing portions provide cooperative mating structures. As shown in detail in FIGS. 5 and 6, in order to provide such mating connection, housing portion 22 includes a pair of extending surfaces 21 at diametrically opposed locations. Each projecting surface 21 includes a row of vertically spaced projecting fingers 26. Similarly, housing portion 24 includes a pair of extending surfaces 23 at diametrically opposed locations. Each projecting surface 23 includes a row of vertically spaced slots 28 which receive the projecting fingers 26 when the housing portions are mated around the neck 12 of bottle 14. The fingers 26 are configured at an angle to permit one way insertion into slots 28.

While in the preferred embodiment, housing portions 22 and 24 include either fingers or slots for mutual engagement, it is contemplated that the housing portions could include both slots and fingers for mutual engagement. More specifically, the housing portions could be formed to be identical hermaphroditic components.

The housing portions 22 and 24 are constructed such that the configuration of the projections and the slots permit one way mating attachment. Detachment of the housing portions can not be readily achieved without damage to the housing 10. In this manner, the electronic tag 16 can not be removed without destructive disassembly of the housing.

As noted above, the present invention provides a tag housing 10 which is designed to be accommodated on a neck 12 of a bottle 14 where the neck includes a circumferential undercut. This circumferential undercut is used in combination with features of the housing to prevent the mated housing from being removed from the neck 12 by sliding the housing up over the neck.

Figure 4:
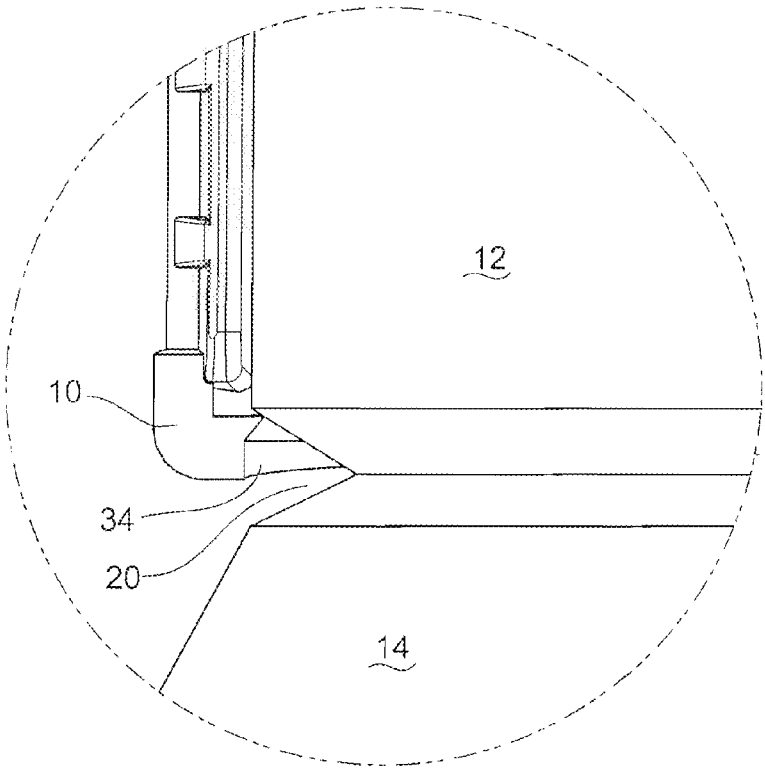
FIG. 4 is an enlarged sectional showing of the bottle neck showing the tag housing attached thereto.

As shown in FIGS. 5 and 6, each of housing portions 22 and 24 include, around the bottom edge thereof, inwardly projecting semi-circular rims 30 and 32, respectively. When assembled and as shown in FIGS. 3 and 4, the semi-circular rims 30 and 32 form a complete circumferential rim 34 which is inwardly directed and extends around the bottom edge of housing 10.

As the housing portions 22 and 24 are mated about the extended neck 12, the rim 34 formed by the two housing portions 22 and 24, seats within the circumferential undercut 20. Since the mated housing 10 can not be disassembled or otherwise enlarged, this seating of the rim 34 within undercut 20 prevents the housing 10 from sliding upward along the neck 12 of bottle 14. This prevents the unauthorized removal of housing 10 therefrom by sliding the housing up over the neck.

While the rim 34 is shown at the lower end of mated housing 10, it can also be provided at the upper end thereof, or for that matter, any location along the length of the housing 10. The upper end of housing 10 also includes an inwardly directed lip 35. The lip 35 closes the housing 10 preventing access to the tag 16 when the housing is mated about the neck 12. If the rim 34 is located at the upper end of the mated housing 10, the lip 35 is positioned at the lower end.

While the rim 34 is positioned so as to mate with the undercut 30 provided on the neck 14 of the bottle 16, it is also contemplated that the housing of the present invention may be applied to a bottle neck having an undercut formed by a label placed around the neck of the bottle.

Figure 7:
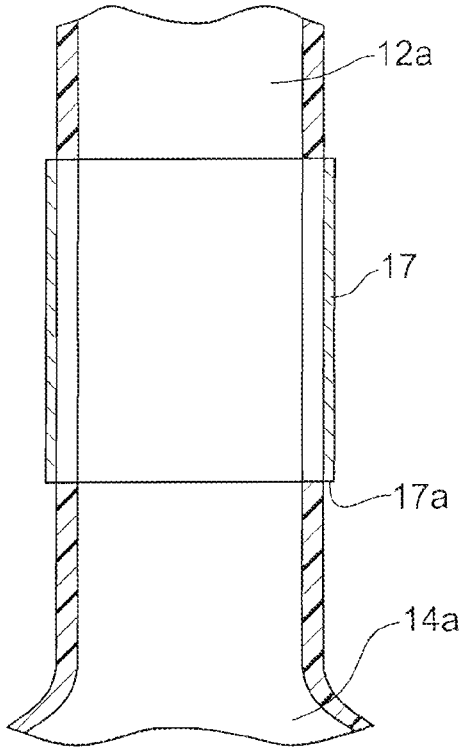
FIG. 7 shows a bottle neck of an alternative configuration to which the tag housing of the present invention may be attached.

With reference to FIG. 7, a neck 12*a* of bottle 14*a* has a label 17 wrapped therearound. The lower circumferential edge 17*a* of label 17 forms the undercut which may be accommodated by the rim 34 of housing 10 to prevent slidable removal therefrom.

Various changes to the foregoing described and shown structures would now be evident to those skilled in the art. Accordingly, the particularly disclosed scope of the invention is set forth in the following claims.

What is claimed is:

1. A device for supporting an electronic tag to an extending neck of a bottle, said extending neck having a perimetrical undercut formed in said neck, said device comprising:

a housing formed of a pair of mateable semi-cylindrical housing portions for attachment about said neck of said bottle forming a cylindrical body having a central bore therethrough for accommodating said neck of said bottle through an upper and lower end of said body, at least one of said housing portion providing support for said tag;

an inwardly projecting rim portion formed on each said housing portion, said rim portion of each said housing portion being mutually aligned to form a perimetrical rim at said lower end of said housing;

said perimetrical rim being seatable in said undercut of said extending neck to prevent longitudinal movement of said mated housing portions along said neck.

2. A device of claim 1 wherein said housing portion includes cooperative mating structure for attaching said pair of housing portions about said neck of said bottle.

3. A device of claim 2 wherein said cooperative mating structures prevent non-destructible detachment of said mating portions.

4. A device of claim 3 wherein said cooperative mating structure includes one said housing portion having fingers extending adjacent said opposed edges and the other said housing portion includes slots adjacent said opposed edges, said fingers being insertable into said slots to secure said housing portions together.

5. A device of claim 2 wherein said housing portions are hermaphroditically formed.

6. A device of claim 1 wherein said at least one of said housing portions includes an internal wall for supporting said tag.

7. A device of claim 6 wherein said internal wall includes a receiving portion for accommodating said tag.

8. A device of claim 1 wherein said each housing portion further includes a lip formed adjacent said upper end thereof, said lip of each said housing portion being mutually aligned to form a perimetrical lip preventing access to said tag when said housing portions are mated.

* * * * *